United States Patent [19]

Horiki et al.

[11] Patent Number: 4,844,285

[45] Date of Patent: Jul. 4, 1989

[54] MASKING MEMBER

[75] Inventors: Seinosuke Horiki; Reiji Makino, both of Nagoya; Hisami Iwata, Aichi, all of Japan

[73] Assignees: Nagoya Oil Chemical Co., Ltd., Tokai; Toyota Jidosha, K.K., Toyota, both of Japan

[21] Appl. No.: 81,294

[22] Filed: Aug. 3, 1987

[30] Foreign Application Priority Data

Aug. 6, 1986 [JP] Japan ..... 120519[U]

[51] Int. Cl.[4] ..... D65D 29/00

[52] U.S. Cl. ..... 220/287; 220/307; 220/DIG. 19

[58] Field of Search ..... 427/282; 128/152; 215/355; 220/287, 352, 354, DIG. 19, 307

[56] References Cited

U.S. PATENT DOCUMENTS 3,442,377 5/1969 Angelus ..... 220/352
4,094,271 6/1978 Louis ..... 220/287
4,615,460 10/1986 Buccellato et al. ..... 220/DIG. 19
4,640,434 2/1987 Johnsen et al. ..... 220/287

*Primary Examiner*—William A. Cuchlinski, Jr.
*Attorney, Agent, or Firm*—Cooper & Dunham

[57] ABSTRACT

A new masking member consisting of an inserting part and a flange formed at the base of said inserting part wherein said inserting part has a shape which partially contacts the inner wall of a hole into which said inserting part is inserted, is presented in the present invention. When said masking member is used, said inserting part of said masking member is inserted into a hole of an article and said flange of said masking member covers the surroundings of said hole. Thus the inside and the surroundings of said hole are protected from a surface treatment and the removing of said masking member after said surface treatment from said hole may be very smooth since said inserting part of said masking member has a shape which partially contacts the inner wall of said hole.

10 Claims, 4 Drawing Sheets

MASKING MEMBER

BACKGROUND OF THE INVENTION

The present invention relates to a new masking member used to protect the inside and circumference of a hole such as a water outlet hole, a cable piercing hole, and the like from a surface treatment such as coating, plating, phosphatizing, vacuum evaporation and the like. More particularly, the present invention relates to a new masking member consisting of an inserting part and a flange formed at the base of said inserting part wherein said inserting part has a shape which partially contacts the inner wall of a hole into which said inserting part is inserted.

In a case where said surface treatment is effected on the surface of an article, said surface of said article often has (a) hole(s) whose inside must be protected from said surface treatment. Said hole(s) may be a water outlet hole, a cable piercing hole, and the like, and a grummet, a plug, a bolt and the like may be inserted into said hole(s).

DESCRIPTION OF THE PRIOR ART

Hitherto, a masking member of the plug type has been used to protect said hole from a surface treatment. Said masking member may be inserted into a hole of an article to be protected before said surface treatment and, when said surface treatment is effected on the surface of an article, said hole of said masking member is not subjected to said surface treatment. After said surface treatment, said masking member may be removed from said hole of said article. Nevertheless, when said masking member is inserted into said hole, the whole circumference of said inserting part of said masking member may come into contact with the inner wall of said hole and therefore the friction between said masking member and said hole may be very large. As a result, said large friction may obstruct the smooth removing of said masking member from said hole.

Further, as said masking member will be useless and abandoned after said masking member is removed from said hole, it may be necessary to save the material cost of said masking member.

SUMMARY OF THE INVENTION

Accordingly, an object of the present invention is to resolve trouble when the masking member is removed from said hole(s) of an article, the inside of which is necessary to be protected from a surface treatment. A further object of the present invention is to save the material cost of the masking member.

According to the present invention, there is provided a masking member consisting of an inserting part and a flange formed at the base of said inserting part wherein said inserting part has a shape which partially contacts the inner wall of a hole into which said inserting part is inserted. When said masking member is used, said masking member is inserted into said hole of said article, the inside of which is necessary to be protected from a surface treatment, and as a result, the inside of said hole is protected from said surface treatment. After said surface treatment, said masking member is removed from said hole without obstruction of friction between said masking member and said hole since the circumference of said inserting part of said masking member may only come into contact partially with the inner wall of said hole.

Said masking member may be made of plastics such as polystyrene, polyethylene, polypropylene and the like, or rubber such as styrene-butadiene rubber, acrylonitrile-butadiene rubber and the like, or a foam of said plastics or said rubber, and said masking member may be colored by (a) suitable color(s) if desired, for the purpose of selection of the specified masking member according to the hole to be inserted. A masking member made of polystyrene foam may be one of the most suitable masking members in the present invention.

DETAILED DESCRIPTION

Figure 1:
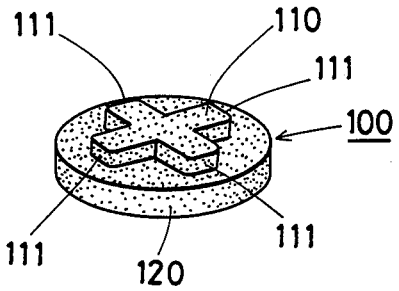
FIG. 1 is a perspective view of the first embodiment of the present invention.

FIG. 1 to FIG. 5 relate to the first embodiment of the present invention. Referring now to FIG. 1, a masking member (100) consists of an inserting part (110) and a flange (120) formed at the base of said inserting part (110). Said inserting part (110) is cross-shaped and only partially contacts the inner wall of a hole at the tips (111) of the cross-shape to save material costs of said masking member (100).

Figure 2:
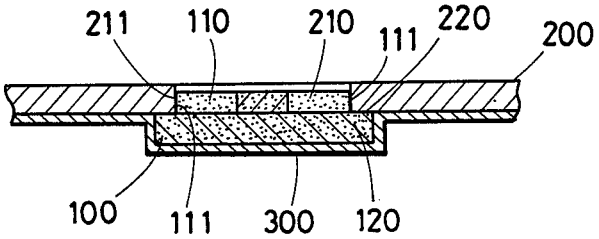
FIG. 2 is a partial side sectional view of the article including a hole after the surface treatment.

When said masking member (100) is used, said masking member (100) protects the inside of a hole (210) of an article (200) by inserting said inserting part (110) into said hole (210) as shown in FIG. 2, and said flange (120) of said masking member (100) covers the surroundings (220) of said hole (210), wherein only said partially contacting parts (111) of said inserting part (110) come into contact with the inner wall (211) of said hole (210).

Figure 3:
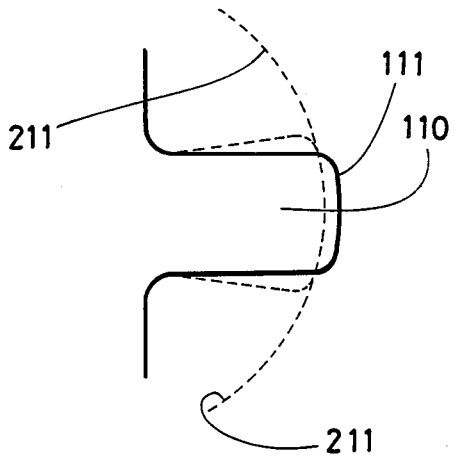
FIG. 3 is a partial plan view to illustrate the elastic deformation of said inserting part of said masking member.

It may be desirable that the diameter of said cross-shaped inserting part (110) is a little larger than the diameter of said hole (210) and in this case, said tips (111) of said cross-shaped inserting part (110) may be elastically deformed by the pressure of the inner wall (211) of said hole (210) as shown by the dotted line in FIG. 3. Thus, said masking member (100) is elastically fixed into said hole (210). After which, a surface treatment such as a coating is effected on the surface of said article (200) to form a film (300) of the surface treatment and the inside and the surroundings of said hole (210) are not subjected to said surface treatment. After said surface treatment, said masking member may be removed from said hole (210) by hand, hook, and the like. In a case where said masking member (100) is made of a thermoplastic foam, said masking member (100) can be removed from said hole (210) by heating at a temperature higher than the softening point of said thermoplastic foam. When said masking member (100) made of said thermoplastic foam is heated to a temperature higher than the softening point of said thermoplastic foam of said masking member it may be softened and gases such as air, gas of a blowing agent, and the like in the cells of said thermoplastic foam may first expand and so said masking member may also expand and, then, when said gases leave the cells, said masking member (100) may shrink rapidly and remove itself naturally from said hole (210). As before mentioned, said inserting part (110) of said masking member (100) contacts partially with the inner wall (211) of said hole (210), so said masking member (100) may be smoothly removed without the obstruction of said friction between said inserting part (110) and said inner wall (211) of said hole (210).

Figure 4:
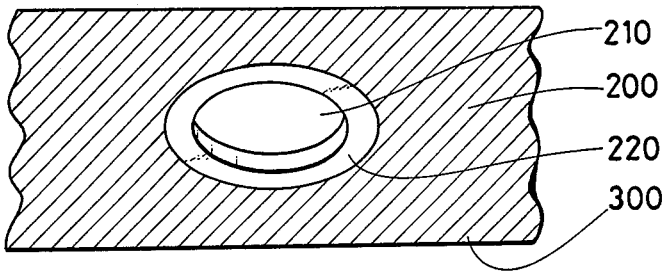
FIG. 4 is a partial perspective view of said article including said hole after the removal of said masking member.
Figure 5:
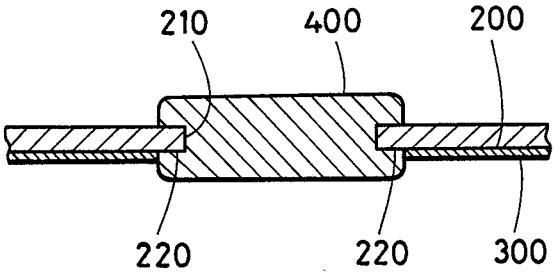
FIG. 5 is a partial side sectional view of the article including said hole into which a grummet has been inserted.

After said masking member (100) is removed from said hole (210), said film (300) has not been formed inside and on said surroundings (220) of said hole (210) as shown in FIG. 4 and a grummet (400) may be tightly inserted into said hole (210) without looseness as shown in FIG. 5.

Figure 6:
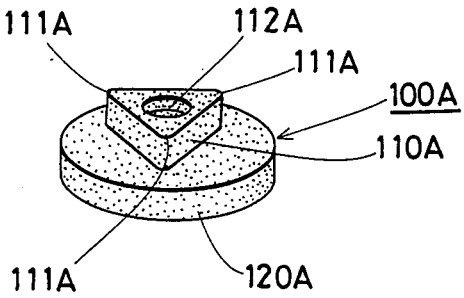
FIG. 6 is a perspective view of the second embodiment.

FIG. 6 relates to the second embodiment. In this embodiment, a masking member (100A) consists of an inserting part (110A) and a flange (120A) formed at the base of said inserting part (110A). Said inserting part (110A) is triangular-shaped and has a hole (112A) in its center, the material cost of said masking member (100A) may be saved by the unused material space around said triangular shape and the area used for said hole (112A).

When said masking member (100A) is inserted into a hole, only the apexes (111A) of said triangular inserting part (110A) come into contact with the inner wall of said hole, and in a case where the diameter of said triangular inserting part (110A) is a little larger than the diameter of said hole, said apexes of said triangular inserting part (110A) may be elastically deformed by the pressure of the inner wall of said hole and, as a result, said masking member (100A) is elastically fixed into said hole.

Figure 7:
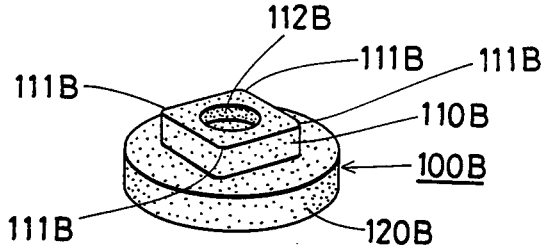
FIG. 7 is a perspective view of the third embodiment.

FIG. 7 relates to the third embodiment. In this embodiment, a masking member (100B) consists of an inserting part (110B) and a flange (120B) formed at the base of said inserting part (110B). Said inserting part (110B) is square-shaped and has a hole (112B) in its center, the material cost of said masking member (100B) may be saved by the unused material space around said square shape and the area of said hole (112B). When said masking member (100B) is inserted into a hole, only the corners (111B) of said square inserting part (110B) come into contact with the inner wall of said hole.

Figure 8:
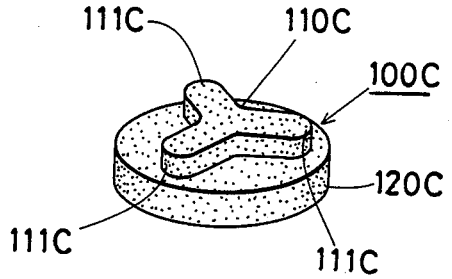
FIG. 8 is a perspective view of the fourth embodiment.

FIG. 8 relates to the fourth embodiment. In this embodiment, a masking member (100C) consists of an inserting part (110C) and a flange (120C) formed at the base of said inserting part (110C). Said inserting part (110C) is of a three forked shape and the material cost of said masking member (100C) may be saved by the unused material space around said three forked shape. When said masking member (100C) is inserted into a hole, only the tips (111C) of said three forked inserting part (110C) come into contact with the inner wall of said hole.

Figure 9:
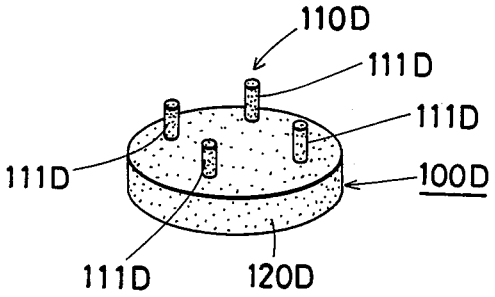
FIG. 9 is a perspective view of the fifth embodiment.

FIG. 9 relates to the fifth embodiment. In this embodiment, a masking member (100D) consists of an inserting part (110D) and a flange (120D) formed at the base of said inserting part (110D). Said inserting part (110D) consists of four columns (111D) and the material cost of said masking member (100D) may be saved by the unused material space around said four columns (111D). When said masking member (100D) is inserted into a hole, only said four columns (111D) of said inserting part (110D) come into contact with the inner wall of said hole.

We claim:

1. A masking member useful for masking an opening comprising a unitary structure made up of an inserting portion suitable for insertion into said opening and a flange portion, said flange portion being fixed to one end of said inserting portion and having an outside dimension substantially larger than the outside dimension of said one end of said inserting portion and larger than the opening into which said inserting portion is adapted to be inserted, said masking member being made of foamed plastic or foamed rubber and said inserting portion of said masking member at said one end having an outside dimension larger than the opening into which said inserting portion is adapted to be inserted, said outside dimension being configured so that upon insertion of said one end of said inserting portion of said masking member into said opening, the outside of said one end of said inserting portion is elastically deformed and provides only partial contact with the opening when inserted thereinto.

2. A masking member in accordance with claim 1 wherein said plastic is selected from the group consisting of polystyrene, polyethylene, polypropylene and wherein said rubber is selected from the group consisting of styrene-butadiene rubber and acrylonitrile-butadiene rubber.

3. A masking member in accordance with claim 1 wherein said plastic is foamed polystyrene.

4. A masking member in accordance with claim 1 wherein said plastic is polypropylene.

5. A masking member in accordance with claim 1 wherein said plastic is a foamed thermoplastic.

6. A masking member in accordance with claim 1 wherein said inserting portion is cross-shaped in cross-section.

7. A masking member in accordance with claim 1 wherein said inserting portion is triangular shaped in cross-section and is provided with a hole in its center.

8. A masking member in accordance with claim 1 wherein said inserting portion is a three lobe structure in cross-section.

9. A masking member in accordance with claim 1 wherein said inserting portion is square shaped in cross-section and is provided with a hole in its center.

10. A masking member in accordance with claim 1 wherein said inserting portion comprises four posts.

* * * * *